US008503919B2

(12) United States Patent
Sone et al.

(10) Patent No.: US 8,503,919 B2
(45) Date of Patent: Aug. 6, 2013

(54) IMAGE FORMING APPARATUS FOR CONTROLLING IMAGE CLARITY USING CLEAR TONER

(75) Inventors: Takuroh Sone, Kanagawa (JP); Kei Yasutomi, Tokyo (JP); Kazuki Funahashi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 286 days.

(21) Appl. No.: 13/012,340

(22) Filed: Jan. 24, 2011

(65) Prior Publication Data

US 2011/0206401 A1 Aug. 25, 2011

(30) Foreign Application Priority Data

Feb. 23, 2010 (JP) ..... 2010-037180

(51) Int. Cl.
*G03G 15/20* (2006.01)

(52) U.S. Cl.
USPC ..... 399/341; 399/67

(58) Field of Classification Search
USPC ..... 399/67, 341
See application file for complete search history.

(56) References Cited

U.S. PATENT DOCUMENTS

| | | | |
|---|---|---|---|
| 6,597,885 | B2 | 7/2003 | Kai et al. |
| 6,625,409 | B2 | 9/2003 | Shakuto et al. |
| 6,757,509 | B2 | 6/2004 | Shoji et al. |
| 6,778,805 | B2 | 8/2004 | Kai et al. |
| 6,800,410 | B2 | 10/2004 | Yasutomi et al. |
| 6,978,109 | B2 | 12/2005 | Shoji et al. |
| 7,212,753 | B2 | 5/2007 | Suzuki et al. |
| 7,212,772 | B2 * | 5/2007 | Kasiske et al. ..... 399/182 |
| 7,463,837 | B2 | 12/2008 | Yasutomi et al. |
| 7,551,868 | B2 | 6/2009 | Yasutomi et al. |
| 7,620,336 | B2 | 11/2009 | Yura et al. |
| 7,657,218 | B2 | 2/2010 | Maruyama et al. |
| 7,738,813 | B2 | 6/2010 | Yasutomi et al. |
| 7,751,746 | B2 | 7/2010 | Miyawaki et al. |
| 7,787,815 | B2 | 8/2010 | Nakamura et al. |
| 7,822,351 | B2 | 10/2010 | Aoki et al. |
| 2006/0133870 | A1 | 6/2006 | Ng et al. |
| 2006/0188301 | A1 | 8/2006 | Ng et al. |
| 2008/0219702 | A1 | 9/2008 | Tsukamoto et al. |
| 2009/0003904 | A1 | 1/2009 | Yasutomi et al. |

(Continued)

FOREIGN PATENT DOCUMENTS

| | | |
|---|---|---|
| JP | 2004-70010 | 3/2004 |
| JP | 2008-129547 | 6/2008 |
| JP | 2009-58941 | 3/2009 |

OTHER PUBLICATIONS

Extended Search Report issued May 19, 2011 in European Patent Application No. 11154097.7 2209.

*Primary Examiner* — G. M. Hyder
(74) *Attorney, Agent, or Firm* — Oblon, Spivak, McClelland, Maier & Neustadt, L.L.P.

(57) ABSTRACT

There is provided an image forming apparatus that includes an image forming unit which forms a chromatic toner image and a clear toner image on a recording material, and a fixing unit which fixes these toner images on the recording material, the image forming apparatus including a specifying unit, into which a level of image clarity and a level of gloss including a glossiness of an image are input for image formation; and a control unit that controls an adhesion amount of clear toner per unit area on the recording material based on input information on the image specified by the specifying unit.

5 Claims, 7 Drawing Sheets

U.S. PATENT DOCUMENTS

2009/0034998 A1 2/2009 Omata
2010/0002265 A1 1/2010 Yasutomi et al.
2010/0021195 A1 1/2010 Yura et al.
2010/0215384 A1 8/2010 Yasutomi

* cited by examiner

SPREAD OF REFLECTED LIGHT: WIDE

SPREAD OF REFLECTED LIGHT: NARROW

IMAGE FORMING APPARATUS FOR CONTROLLING IMAGE CLARITY USING CLEAR TONER

CROSS-REFERENCE TO RELATED APPLICATIONS

The present application claims priority to and incorporates by reference the entire contents of Japanese Patent Application No. 2010-037180 filed in Japan on Feb. 23, 2010.

BACKGROUND OF THE INVENTION

1. Field of the Invention

The present invention relates to an image forming apparatus.

2. Description of the Related Art

Recently, there is known a color electrophotographic technology for controlling glossiness of an image by superimposing a clear toner image on four-color toner images of yellow, magenta, cyan, and black.

For example, in Japanese Patent Application Laid-open No. 2009-058941, clear-toner usage is controlled according to a print mode. For example, if a print image is a monochrome image, the clear toner is not used in a monochrome print mode, or printing is performed with suppressing clear-toner usage more than that in a color print mode. Likewise, there is disclosed a technology for controlling clear-toner usage according to a mode such as a photo image mode, a toner saving mode, and a high-speed printing mode. When the print image is a monochrome image, the clear toner is not used in the monochrome print mode or printing is performed with suppressing clear-toner usage more than that in the color print mode, and this allows an image with optimal gloss to be output.

In addition, Japanese Patent Application Laid-open No. 2008-129547 discloses an image forming apparatus that includes color-image forming units for forming color images using a plurality of chromatic toners, and a clear-toner image forming unit for forming a clear toner image. The image forming apparatus has an image forming mode in which a text portion is formed with the clear toner, and forming conditions to form a latent image of the clear toner image in the text portion in image data can be changed. As this apparatus, there is invented an image forming apparatus capable of outputting an image having glossiness that user desires by changing an adhesion amount of the clear toner per unit area according to image input information for controlling the level of glossiness.

Furthermore, in Japanese Patent Application Laid-open No. 2004-070010, a glossiness detector for detecting glossiness of an image on a sheet is provided in a post-process of a fixing device. As test patterns for measuring glossiness, three-color gray gradation patterns (patches) in which a toner adhesion amount is largely changed are created, and the glossiness of each patch is detected by the glossiness detector. Parameters on image formation such as fixing conditions are set so as to reduce a difference in the glossiness between the patches (images). Although the clear toner is not used in this apparatus, there is invented a technology for equalizing glossiness from halftone to a solid portion by detecting the glossiness of an output image and changing the fixing conditions.

As explained above, there exist the technologies for controlling the glossiness by changing the adhesion amount of the clear toner or the like, however, none of the inventions are technologies for controlling gloss or glossy feeling perceived by humans.

First, the glossiness will be explained below before the glossy feeling is discussed. The glossiness is a physically measured quantity indicating intensity of a light amount obtained such that light is irradiated to a surface and is reflected thereon in a specular direction. A measurement method of glossiness is defined in JIS-Z8741. The measurement method of glossiness is performed by causing a parallel light to enter a sample object to be evaluated at a defined angle of incidence θ, detecting a light flux reflected on the sample object in the specular direction by a light receiver, and normalizing the detected reflected light flux using a reflected light flux detected on a standard plane (which is a glass surface whose refractive index over an entire range of visible wavelength is 1.567) under the same condition as above.

The measurement method of glossiness defines measurement methods in which 20°, 45°, 60°, 75°, and 85° are adapted as an angle of incidence θ. In general, a method for measuring light incident at a small angle of incidence is preferably used to measure an object to be evaluated with high specular gloss. On the contrary, a method for measuring light incident at a large angle of incidence is preferably used to measure an object to be evaluated with low specular gloss. In a case of an electrophotographic image, 20° and 60° are often used as the angle of incidence θ. In order to quantify subjective glossy feeling perceived by humans, the measurement of glossiness is widely implemented.

However, many literatures point out that the glossiness and the subjective glossy feeling do not necessarily coincide with each other. The reason is because when humans feel gloss, they do not perceive gloss only by the intensity of specular light amount from a sample but perceive gloss including the degree of spread of the reflected light.

The spread of the reflected light will be explained below with reference to FIGS. 1A and 1B. Among lights reflected from a sample, the intensity of the light in the specular direction is the highest. The lights reflected on the sample include some lights diffused on a surface other than that in the specular direction. If the reflected light is widely diffused on the surface, as shown in FIG. 1A, the amount of the reflected light near the specular direction is also high, and thus the spread of the reflected light is wide. Conversely, because diffused reflection on the surface is narrow in FIG. 1B, the spread of specular reflected light is narrow.

Humans perceive glossy feeling based on not only the intensity of the specular reflected light but also the spread of the reflected light in the above manner, and, therefore, it is difficult to quantify the glossy feeling only by the glossiness. Therefore, there is widely known a method of measuring image clarity in order to quantify the spread of reflected light. The image clarity is a gloss characteristic, which is observed on the surface of a high-gloss image such as silver halide photography, indicating the intensity of a light source reflected into the surface of the screen. The image clarity affects not only the silver halide photography but also the glossy feeling of an image formed by an electrophotographic image forming apparatus or an ink-jet image forming apparatus. As the method of measuring image clarity, "JIS K 7105" and "JIS H 8686" or the like are used.

When the spread of the reflected light is wide, the image clarity is low, but when the spread of the reflected light is narrow, then the image clarity is high. As explained above, if not only the level of the glossiness but also the level of the image clarity is not controlled, it is difficult to output an image with glossy feeling the user desires.

Next, advantages of controlling the glossiness and the image clarity that determine the glossy feeling will be discussed below. The glossy feeling can be largely divided into the following four classifications such as A, B, C, and D.

A. Case of Low Image Clarity and Low Glossiness

In this case, the image clarity is low and the glossiness is low. Users frequently handling text files such as office documents prefer this case. If the glossiness and the image clarity of text are high and when the light from a fluorescent light is reflected on the text, then the reflected light enters user's eyes, which causes the user to feel glaring and the user's eyes get tired very much. To avoid the glare, this type of glossy feeling is required for a graph or the like which is inserted into the office document.

B. Case of Low Image Clarity and High Glossiness

In the case where the image clarity is low and the glossiness is high, reflection of an image is low because of the low image clarity. Thus, when the user looks at an image, a reflection into the image, which is a reflection of the face or the like of the user, is low. On the other hand, because the glossiness is high, this allows glaring to be given. Therefore, when a particular image is desired to be emphasized while a face is not desired to be reflected into the particular image, the glossy feeling categorized as the case B is required. For example, when advertisement in a train is desired to be accentuated but faces of passengers are desired to be avoided from being reflected thereinto, the classification B is effective. In addition, in most cases, the glossiness is high but the image clarity is low in output images on high-quality paper used in offset printing. When an image like that in offset printing is desired to be output, an image having the glossy feeling categorized as B is required.

C. Case of High Image Clarity and Low Glossiness

In this case, the image clarity is high and the glossiness is low. This is effective when an image, which resembles an image on a gloss paper or the like formed by an inkjet printer, is desired to be output. In electrophotography, an image having both high glossiness and high image clarity can be obtained by cold release, while in conventional electrophotography, it is difficult to output an image having high image clarity but low glossiness. On the contrary, an inkjet printer can output an image having low glossiness and high image clarity depending on various types of gloss papers. Such an image is soft and expensive looking, but this image is difficult to be output in electrophotography. If the user desires the glossy feeling like that of the image printed by the inkjet printer using the gloss paper, the glossy feeling categorized as C has to be given.

D. Case of High Image Clarity and High Glossiness

In this case, the image clarity is high and the glossiness is high. This case is effective when the glossy feeling like that of a silver halide photography is desired to be given. If the glossy feeling with high glossiness and expensive looking like in silver halide photography or a print by a digital camera is desired to be given, the glossy feeling of D is preferred. The conventional electrophotography allows the glossy feeling when the cold release technology is used.

As explained above, all the four categories have to be satisfied in order to control the glossy feeling of the image. However, in many cases, the conventional electrophotographic image forming apparatuses can control only A and D using the cold release technology, and thus, there does not exist any electrophotographic image forming apparatus capable of expressing all the glossy feelings. Particularly, there is no electrophotographic image forming apparatus that can independently control image clarity from glossiness.

The present invention has been achieved to solve the conventional problems, and an object of this invention is to provide an image forming apparatus that can output an image having glossy feeling a user desires by controlling image clarity using clear toner.

SUMMARY OF THE INVENTION

It is an object of the present invention to at least partially solve the problems in the conventional technology.

According to an aspect of the present invention, there is provided an image forming apparatus that includes an image forming unit which forms a chromatic toner image and a clear toner image on a recording material, and a fixing unit which fixes these toner images on the recording material, the image forming apparatus including: a specifying unit, into which a level of image clarity and a level of gloss including a glossiness of an image are input for image formation; and a control unit that controls an adhesion amount of clear toner per unit area on the recording material based on input information on the image specified by the specifying unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1A:
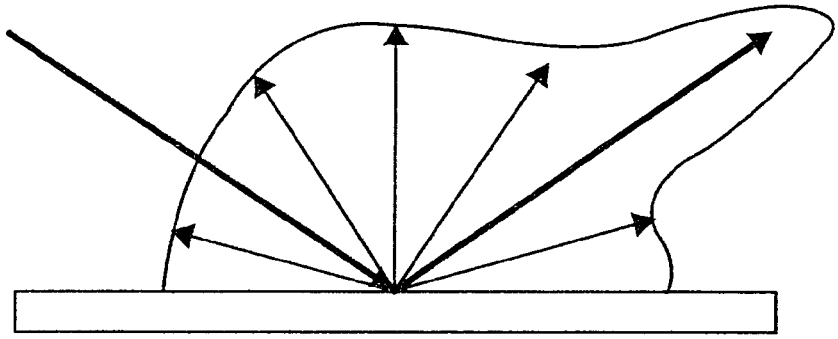
FIGS. 1A and 1B are explanatory diagrams of reflected lights on surfaces of toner.
Figure 1B:
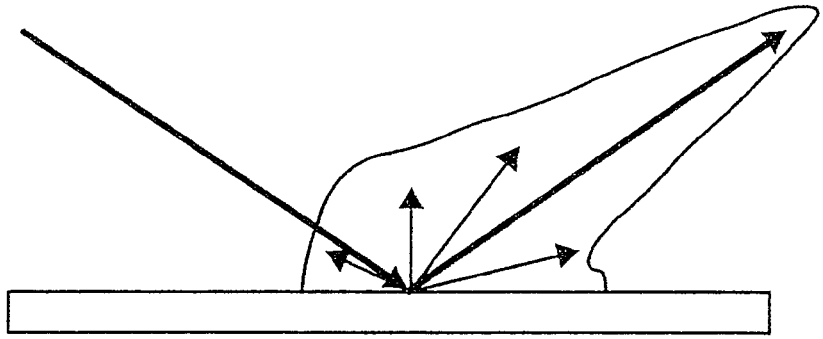
Figure 2:
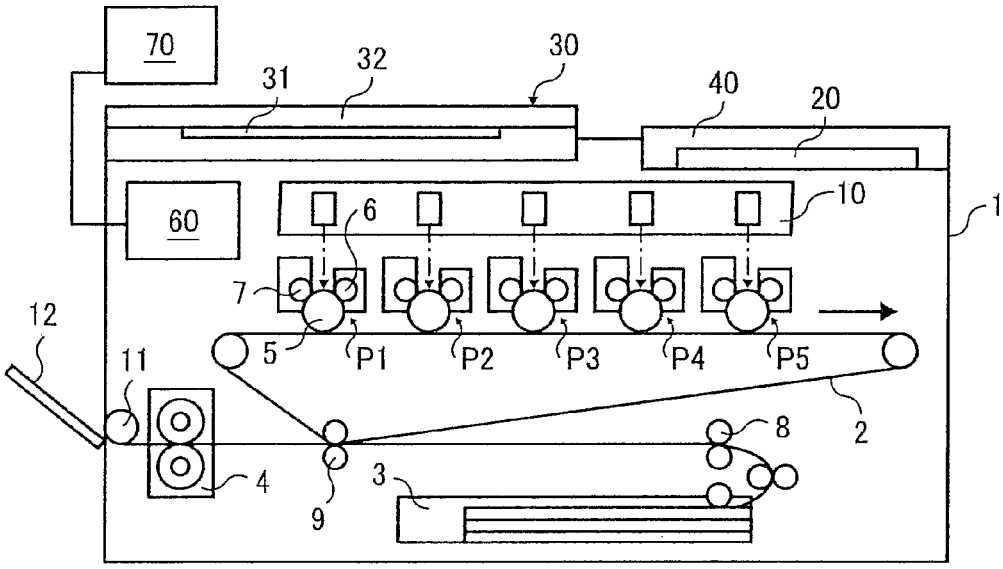
FIG. 2 is an configuration diagram showing an image forming apparatus according to the present invention.

Embodiments of the present invention will be explained in detail below with reference to the accompanying drawings. FIG. 2 is a pattern diagram showing a schematic configuration of an image forming apparatus according to the present invention. The image forming apparatus shown herein includes an image forming unit for forming an image on a recording material using color toners (chromatic toners) and clear toner, and a fixing device for fixing the toner image formed by the image forming unit on the recording material. More specifically, the image forming apparatus is a five-drum tandem type full color electrophotographic recording apparatus.

In FIG. 2, reference numeral 1 denotes an image forming apparatus body. Arranged on the upper side of the apparatus body 1 are an operating unit (operation panel) 20 through which a command is input by a user and which informs the user of a status of the apparatus; a scanner (original reading unit) 30 that optically scans an original and photoelectrically read the original through color separation; and an area specifying device (digitizer) 40 that includes a function for specifying an area of image information, and a function for displaying an image scanned by the scanner 30. Moreover, reference numeral 60 denotes a controller (control circuit (CPU)) incorporated in the apparatus body 1, which integrally controls the image forming apparatus. In addition, reference numeral 70 denotes an external input device (external host device) such as a personal computer and a facsimile device, which is connected to the controller 60 through an interface.

Provided inside the apparatus body 1 are first to fifth electrophotographic image forming units P1 to P5 which are horizontally arranged from the upper right to the left in the figure. P1 to P4 are color image forming units and P5 is a clear image forming unit. Reference numeral 10 denotes a laser scanning mechanism (laser scanner) having a plurality of optical scanning units which are disposed on the upper side of the first to the fifth image forming units P1 to P5. Reference numeral 2 denotes a transfer belt mechanism disposed under the first to the fifth image forming units P1 to P5. Reference numeral 3 denotes a paper feed cassette (cassette paper feeder), and reference numeral 4 denotes a fixing device (heating roller fixing device) disposed in the downstream side of the transfer belt mechanism 2 in a recording-material conveying direction.

In the scanner 30, reference numeral 31 denotes an original glass plate, and reference numeral 32 denotes an original retainer plate capable of opening and closing with respect to the original glass plate. A color original is placed on the glass 31 with an image surface down according to a predetermined placing reference and is covered with the retainer plate 32, so that the original is set. Alternatively, it can be configured such that the retainer plate 32 is replaced with an automatic document feeder (ADF, RDF) and a sheet-type original is automatically fed onto the glass 31. There is provided a moving optical system driven to be moved under the glass 31, and the downward-facing surface of the original on the glass 31 is optically scanned by the moving optical system. A scanned light of the original is imaged on a CCD being a photoelectric conversion element (solid-state image sensing device) and is read by color separation based on three primary colors of RGB (red, green, and blue). The read signals of RGB are input to an image processing unit controlled by the controller 60.

The image processing unit controls the laser scanning mechanism 10 to output laser lights, which are modulated according to image information from the scanner 30 (electric image information) read through color separation, to the first toward the fifth image forming units P1, P2, P3, P4, and P5, respectively. In a printer mode, electric image information, which is input to the controller 60 from the external host computer 70 such as PC through an interface unit as an input unit, is processed by the image processing unit and the apparatus body 1 functions as a printer.

The first to the fifth image forming units P1 to P5 have the same electrophotographic process configuration. More specifically, each of the image forming units includes an electrophotographic photosensitive drum (hereinafter, "drum") 5 as an image carrier. Each of the image forming units also includes an entire surface exposure lamp (not shown), a charger 6, a developing unit 7, and a drum cleaner (not shown), which are process units acting on the drum 5. A developer used in the first to the fifth image forming units P1 to P5 is a two-component developer in which toner and magnetic carrier particles are mixed. Developing units of the first to the fourth image forming units P1 to P4 store therein two-component developers in which color toner of C color (cyan), M color (magenta), Y color (yellow), or K color (black) is mixed with magnetic carrier particles, respectively. The toners of C color, M color, Y color, and K color are controlled to be supplied from a supply device (not shown) so that toner concentration of each developer in the developing unit is maintained at a predetermined amount. Stored in the developing unit 7 of the fifth image forming unit P5 is a two-component developer in which the clear toner is mixed with the magnetic carrier particles. The transfer belt mechanism 2 conveys the recording material using a transfer belt to each transfer unit that faces the drum 5 of each of the image forming units.

The operation for forming a full-color image is as follows. The first to the fifth image forming units P1 to P5 are sequentially driven according to a predetermined control timing. Each drum 5 is rotated clockwise by the drive. The transfer belt in the transfer belt mechanism 2 is also driven to rotate. The laser scanning mechanism 10 is also driven. The charger 6 uniformly charges the surface of each drum 5 to predetermined polarity and potential in synchronization with the drive. The laser scanning mechanism 10 performs scanning and exposure with a laser beam according to an image signal corresponding to the surface of each drum 5. This leads to formation of an electrostatic latent image according to the image signal corresponding to the surface of each drum 5. More specifically, the laser scanning mechanism 10 causes a laser light emitted from a light source unit to scan by rotating a polygon mirror, deflects a light flux of the scanning light by a reflective mirror, converges the light flux onto a bus bar of the drum 5 by an fθ lens, and exposes the surface. Thus, an electrostatic latent image according to an image signal is formed on the drum. The formed electrostatic latent image is developed as a toner image by the developing unit 7.

The first to the fourth image forming units P1 to P4 are color image forming units (chromatic image forming units) that form color images using a plurality of chromatic toners, respectively. The fifth image forming unit P5 is a clear-toner image forming unit (clear image forming unit) that forms a clear toner image.

On the other hand, a paper feeding roller of a paper feeding unit in the paper feed cassette 3 is driven. Thus, one sheet of recording materials stacked in the paper feeding unit is separated and fed. The recording material is supplied to a transfer belt of the transfer belt mechanism 2 through a plurality of transfer rollers and a registration roller 8. The recording material supplied to the transfer belt is sequentially fed to the transfer units of the first to the fifth image forming units P1 to P5 by the transfer belt. When it is checked that the transfer belt is driven to rotate and is located at a predetermined position, then the recording material is fed to the transfer belt from the registration roller 8, and conveyed toward the transfer unit of the first image forming unit P1. At the same time, an image writing signal is turned on, and an image is formed on the drum 5 of the first image forming unit P1 at a predetermined control timing based on the turn-on. Then, a transfer charging unit applies an electric field or an electric charge to the drum 5 at the transfer unit on the lower side of the drum 5, and thus a toner image of C color as a first color formed on the drum 5 is transferred to the recording material. With this transfer, the recording material is firmly held on the transfer belt by means of electrostatic attractive force, and is then conveyed to the second image forming unit P2 and the subsequent ones. Furthermore, the recording material sequentially receives the transfer of color toner images of an M-color toner image, a Y-color toner image, and a K-color toner image formed on the drums 5 of the second to the fourth image forming units P2, P3, and P4, respectively. Thus, not-yet-fixed full color toner images consisting of four colors (C color+M color+Y color+K color) are combined to be formed on the recording material.

When the clear toner is to be used, then the recording material further receives the transfer of a clear toner image formed on the drum 5 of the fifth image forming unit P5 at the transfer unit of the fifth image forming unit P5. Toner images formed by combining the full-color toner images consisting of the four colors of C color+M color+Y color+K color or formed by further superposedly transferring the clear toner image thereto are transferred to the recording material by a secondary transfer unit 9. The charge on the recording material after the transfer is removed by a separation charger (not shown) at the downstream in the conveying direction of the transfer belt, so that the electrostatic attractive force is attenuated. Thus, the recording material is separated from an edge of the transfer belt. The recording material separated from the transfer belt is conveyed to the fixing device 4 by a conveyor belt, and the toner images on the recording material are fixed thereon by heat and pressure in the fixing device 4. The recording material passing through a fixing nip portion of the fixing device 4 is conveyed and ejected by a fixed-paper ejection roller 11. Then the recording material is ejected on a paper ejection tray 12 provided outside the apparatus body 1.

Next, an image-clarity control technology will be considered before a control method implemented to change glossiness and image clarity is explained. It is well known that the glossiness can be controlled using a fixing temperature and a fixing time, however, the image-clarity control technology is hardly known.

The inventors therefore examined the characteristics of an image surface to determine the image clarity. As a result of this, it is found that the image clarity is changed by the number of rough parts per unit area. Here, the unit area equals to 1 $cm^2$, and each rough part has vertical width and horizontal width in 0.1 to 0.3 mm.

The details of the experiment will be explained below. A sample was prepared by adhering clear toner, in which tone values are changed, to POD gloss coated paper 126 $g/m^2$ (Oji Paper Co. Ltd.) being a coated paper using the electrophotographic image forming apparatus.

Figure 3:
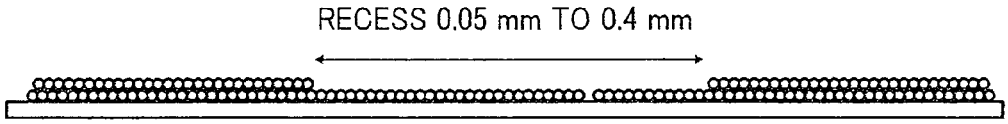
FIG. 3 is a schematic showing an adhesion state of clear toner.

Halftone processing of the clear toner caused to adhere to the recording material was implemented by preparing a recess so that the recess was present in such a manner that its vertical width and horizontal width were always the same size as each other. Furthermore, in order to prepare the recess, an image having a two-layer portion of a clear toner layer and a one-layer portion (recess) of the clear toner layer was created (see FIG. 3).

For the recess, a sample was prepared by gradually changing the number of recesses per unit area, and the clear toner was caused to adhere to the surface so that each interval between recesses was equally spaced. Sizes of the width of the recess were prepared by changing them in a range from 0.05 mm to 0.4 mm. A patch size was set to 5 cm×5 cm.

Figure 4:
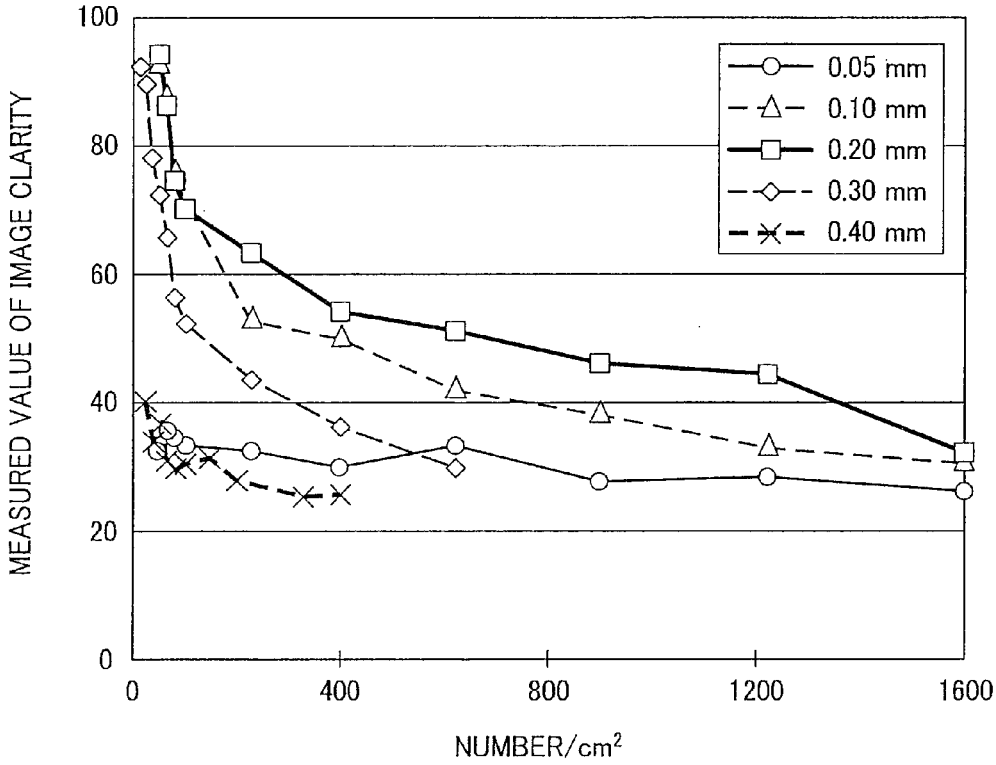
FIG. 4 is a diagram showing a relationship between the number of recesses per unit area and image clarity.

A relationship between the number of recesses per unit area (number/$cm^2$) in the sample and a measured value (optical comb width: 2.0 mm) measured by an image-clarity tester (Suga Test Instrument ICM-1T) is shown in FIG. 4. It is found that when the width is 0.1 mm, 0.2 mm, and 0.3 mm, the image clarity monotonically decreases as the proportional quantity of recesses increases. Conversely, when the width is 0.05 mm and 0.4 mm, the image clarity does not increase even when there are a small number of recesses, and thus there is no change.

That is, it is found that the image clarity can be controlled by adhering the clear toner to the surface so as to obtain recesses whose width is 0.1 to 0.3 mm in the above manner and controlling the number of the recesses. The present invention provides the image forming apparatus for forming the chromatic toner images and the clear toner image on the recording material. The image forming apparatus includes the specifying unit by which the user previously specifies an area whose image clarity is desired to be increased, and the controller that controls the adhesion amount of the clear toner per unit area on the recording material based on the input information for the image specified by the specifying unit, thereby controlling the image clarity that cannot be controlled by the conventional electrophotographic image forming apparatus. Moreover, also by controlling the glossiness, it is possible to provide the image forming apparatus capable of outputting the image with glossy feeling which cannot be reproduced in the conventional technology.

A control method for changing glossiness and image clarity will be explained below. The adhesion amount of the clear toner image, which is to be superimposed on the color toners on the four-color toner images, is controlled based on the image clarity previously desired by the user, thereby the rough state on the surface of the toner images on the recording material is changed. The controller 60 in FIG. 2 calculates the height of toner in each image portion of chromatic toners formed on the surface of the recording material from image data by a toner-height calculator. Next, a print amount of each portion of the clear toner is calculated by a clear-toner print-amount calculator based on the height of the chromatic toners in the image portion. As explained above, in the image forming unit using the clear toner, the photosensitive drum where a clear toner image is formed is exposed according to the image information of the other four-color image forming units, and an electrostatic latent image is thereby formed. Then, the clear toner image is formed based on the electrostatic latent image.

Figure 5:
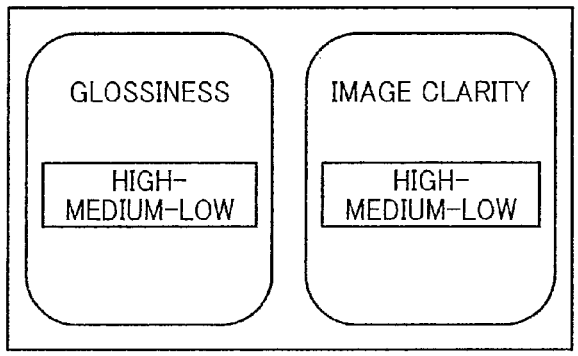
FIG. 5 is a schematic showing a display unit.

Next, the method of specifying image clarity and glossiness beforehand by the user will be discussed. As shown in FIG. 5, the user inputs "high, medium, low" or a numerical value for each of glossiness and image clarity of an image to be output, to the display unit of the operating unit 20 that displays the information, and specifies the levels of glossiness and image clarity.

The same goes for printer output (printer mode). Similarly to the above, desired levels of glossiness and image clarity are specified on a control screen of a printer. The electric information is input to the controller 60. The controller 60 having received the electric information, which indicates image information and specification information, controls the image forming apparatus based on the electric information.

The control for the image clarity of the toner image is performed by controlling the adhesion amount of the clear toner. Here, the adhesion amount of the clear toner is controlled so that the surface of toner, in which the clear toner image is superimposed on the color toner images, obtains recesses whose vertical width is 0.1 to 0.3 mm, horizontal width is 0.1 to 0.3 mm, and depth is 0.5 to 15.0 μm. Moreover, the clear toner is transferred to the recording material so as to decrease the number of recesses per unit area when the image clarity is desired to be increased, and so as to increase the number of recesses when the image clarity is desired to be decreased.

Figure 6:
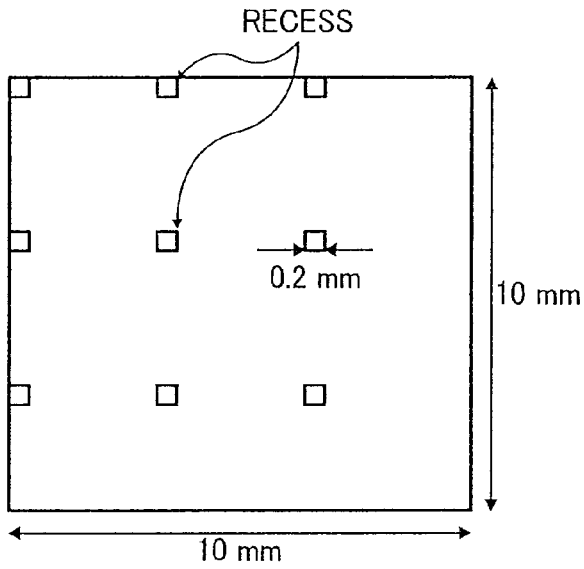
FIG. 6 is a schematic showing an adhesion distribution of the clear toner.
Figure 7:
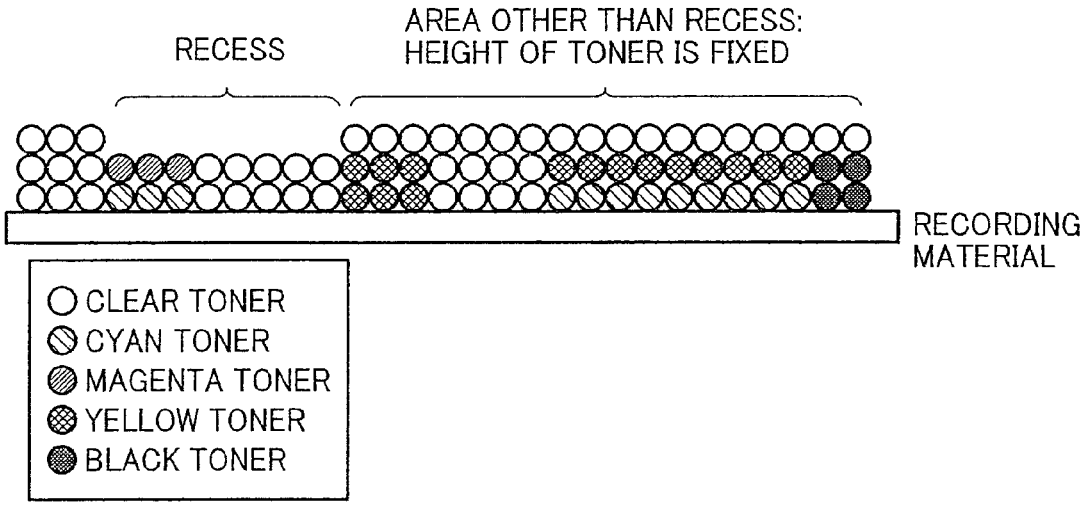
FIG. 7 is an explanatory diagram of an adhesion method of the clear toner.

FIG. 6 shows an example of distribution of recesses in an area of 10 mm square. The recesses are formed so as to be equally spaced. As shown in FIG. 7, the clear toner is transferred so that the height of toner on the surface other than the recess is always fixed.

By changing the number of recesses per unit area (number/$cm^2$), the image clarity is controlled. Here, the amount of change in the image clarity with respect to the number of recesses per unit area is affected by resin characteristics of the clear toner. Thus, a relationship between "number/$cm^2$" and "image clarity" needs to be determined beforehand.

The glossiness of the toner image is controlled by controlling the fixing temperature and the fixing time in the fixing device 4. When the glossiness is desired to be increased, the fixing temperature is increased and, in addition, the fixing time is prolonged by decreasing the conveying speed upon the fixing. As the method for controlling the glossiness using the fixing conditions, the method used in a conventional electrophotographic image forming method may be used.

A mechanism capable of controlling the glossiness and the image clarity by the above control will be explained below. The glossiness is affected by the smoothness of the surface, but specifically it is affected by an amount of light diffusely reflected on the surface due to micro rough parts of several μM. It is widely known that the glossiness of the toner can be controlled by the fixing temperature and the fixing time. This is because the glossiness is changed depending on the degree of collapse of the toner particle, which is spherical or substantially spherical. More specifically, if toner having a particle size of several μM is not completely fused and the spherical shape is left as it is because of a low fixing temperature or a short fixing time, then the rough parts of several μM are left on the surface. In this case, the amount of light diffused on the surface is increased, and the glossiness is thereby decreased. Conversely, if the toner is completely fused and the surface is smoothed, then the amount of diffused light on the surface is reduced, so that the glossiness increases.

On the other hand, the image clarity indicates distortion of an image perceived by humans or the level of its sharpness. Subjective evaluation is performed by the degree of reflection of an image of, for example, a light source (fluorescent light etc.) into the image, and then measuring conditions (angle to be measured, optical comb width) of an image-clarity tester are determined after the subjective evaluation. Therefore, the image clarity is a characteristic value that corresponds to spatial frequency characteristic of human's eye, and the image clarity is hardly affected by micro rough parts unlike glossiness but is affected by the distortion of the image due to macro rough parts of about 0.2 mm.

As explained above, in the first embodiment, the adhesion state of the clear toner is controlled based on the image clarity specified by the user, and further the fixing conditions is controlled based on the specified glossiness. With this, the image with the glossy feeling which cannot be formed by the conventional electrophotographic image forming apparatus can be formed without addition of any complicated configuration.

Next, another embodiment of the present invention will be explained below. In the first embodiment, the glossy feeling of the entire output image is controlled. However, this embodiment provides an image forming apparatus capable of controlling glossy feeling on an image area specified by the user. The main configuration is the same as that of the first embodiment, and thus only different units will be explained below.

Figure 8:
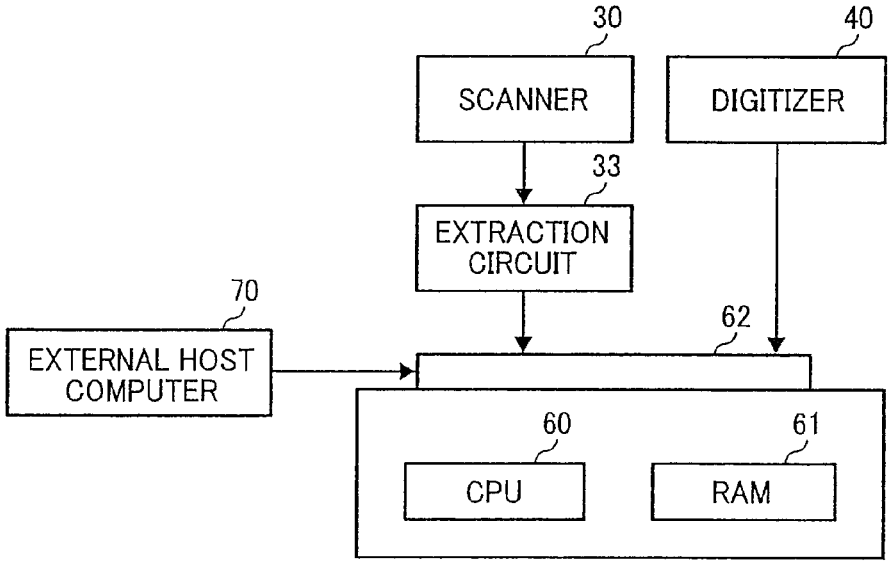
FIG. 8 is a block diagram of a configuration of another embodiment of the present invention.

Image forming conditions are controlled based on desired image clarity and glossiness for an image area previously specified by the user on four-color toner images. First, the user places an original on the digitizer 40 before copy operation, and specifies an area as an arbitrary position on the original with a digitizer pen or the like, then a RAM 61 of FIG. 8 stores coordinate data of the specified position on the original. Next, the user sets the original on a predetermined original reading position of the scanner 30, and presses a copy start button of the operating unit 20.

This allows the area of the original including the previously stored coordinates to be scanned. Specified-coordinate position information obtained at that time is sampled by an extraction circuit 33 in the figure.

Figure 9:
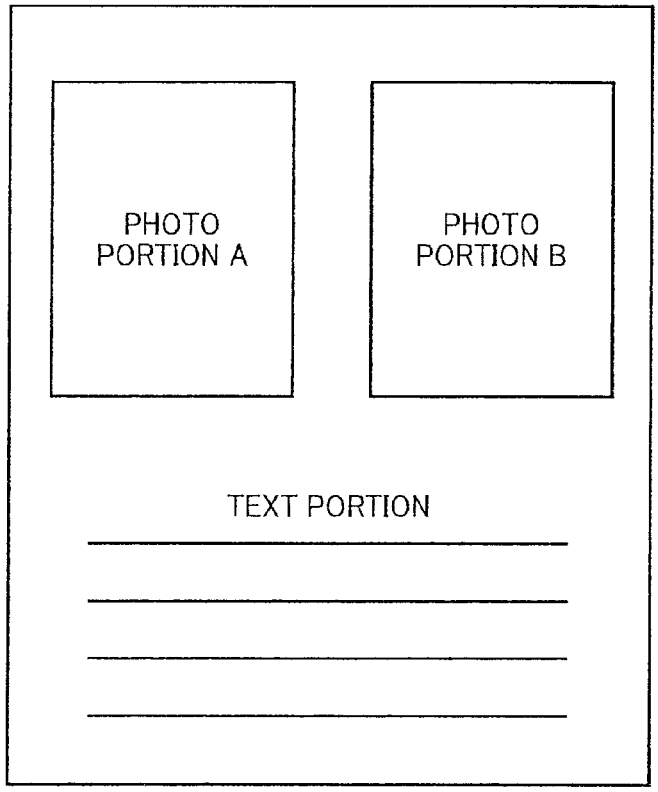
FIG. 9 is a diagram of an image example.
Figure 10:
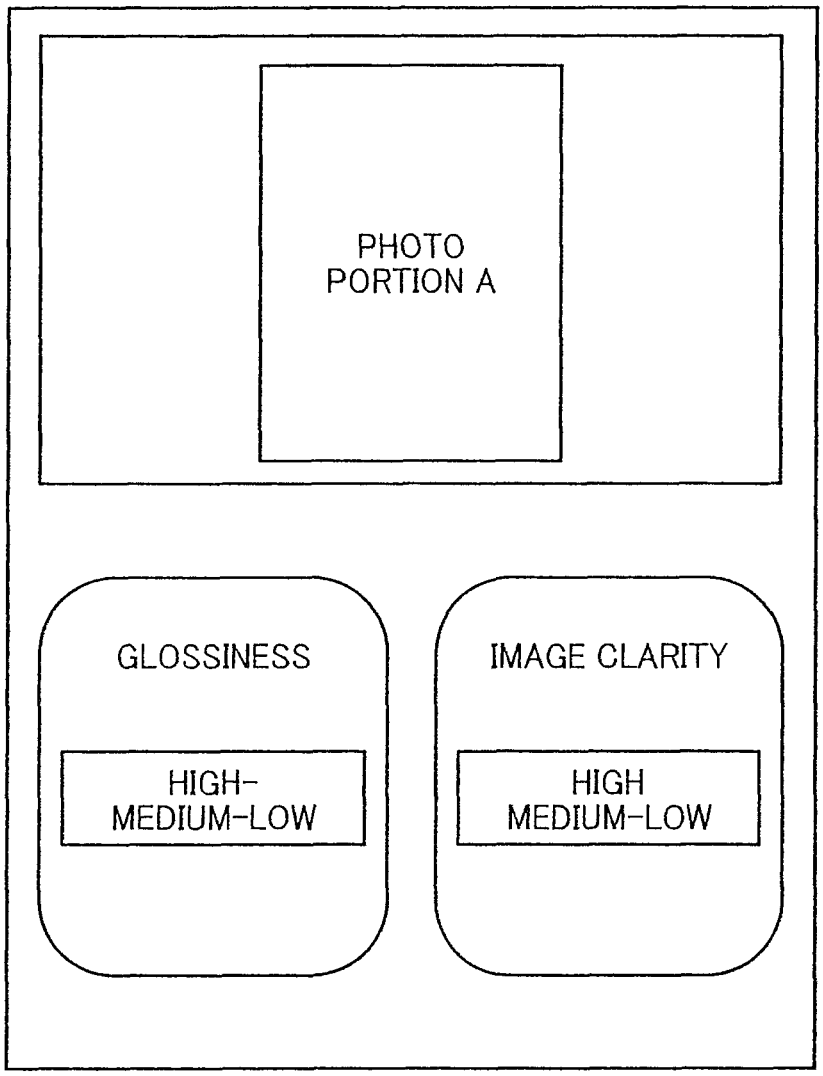
FIG. 10 is a display unit on which the glossiness and the image clarity of a specified image area are specified.

More specifically, for example, when there is an image as shown in FIG. 9 and if a photo portion A is specified as an area with a digitizer pen, then information for the photo portion A is sampled. As shown in FIG. 10, the sampled information for the photo portion A is displayed on a display unit for displaying information of the operating unit 20. The user inputs any of high, medium, and low levels or numerical values of the glossiness and the image clarity, respectively, regarding a portion of the information for the photo portion A. Thus, the levels of glossiness and image clarity are specified. The same goes for the printout (printer mode). In the printer mode, similarly to the above, an image area whose glossiness and image clarity are desired to be controlled is selected and specified on a control screen for a printer. Electric information for the specified image area is input to an interface unit 62, which is an input unit, and then input to the controller 60. Upon reception of the electric information indicating the image information and the specification information, the controller 60 controls the image forming apparatus based on the electric information.

The subsequent processes are the same as those of the above described embodiment, and thus explanation thereof is omitted. As explained above, in the present embodiment, glossy feeling of a specified area in an image plane can be controlled. Therefore, it is possible to provide an image forming apparatus capable of expressing image portions with different glossy feelings in one image when a plurality of photo images, such as a glaring photo image and a high-quality photo image, is provided in the one image plane.

Still another embodiment of the present invention will be explained in detail below. In the present embodiment, image forming conditions, particularly, fixing conditions are controlled according to a type of paper. There are various types of recording materials on which the toner is fixed and there are also various paper thicknesses. Because change in the paper thickness causes an amount of heat applied to the paper by the fixing device 4 to vary, it may also be difficult to control the glossiness and the image clarity desired by the user with high accuracy depending on a paper type.

Figure 11:
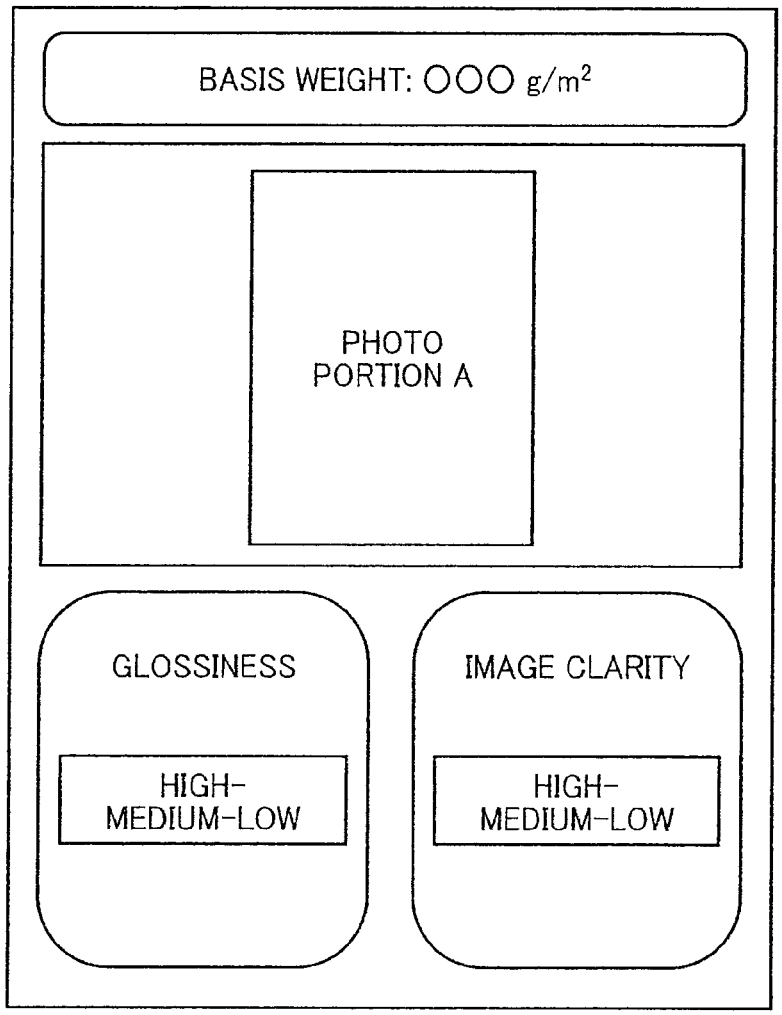
FIG. 11 is a diagram showing a basis-weight input portion.

Therefore, a relationship between the glossiness and the image clarity related to basis weights of paper types is given in a form of a table beforehand, and the fixing conditions (fixing temperature and fixing time) for the fixing device 4 are optimized. When an image is to be output, as shown in FIG. 11, the user inputs the basis weight for the type of paper to be output. The fixing conditions for the fixing device 4 are controlled so as to correspond to this value. In the present embodiment, the fixing conditions are controlled based on the basis weight. Alternatively, a method for controlling the fixing conditions based on, for example, a name of the paper type and smoothness of paper may be used.

As explained above, it is possible to provide the image forming apparatus that performs highly accurate glossiness control and image clarity control by controlling the fixing conditions according to the paper type.

According to the embodiment, it is possible to provide the image forming apparatus capable of gradually controlling image clarity of an image which is difficult to be reproduced in the conventional electrophotographic technology. According to the embodiment, an image that has partially different image clarities can be formed in one image plane. Therefore, it is possible to provide the image forming apparatus capable of expressing image portions with different glossy feelings, such as a glaring photo image portion and a high-quality photo image portion, within one image when the image plane contains a plurality of photo image portions.

According to the embodiment, the height can be controlled according to the amount of a color toner provided in a lower layer than the clear toner, and, further, by controlling the shape on the surface, the image clarity can be gradually controlled without depending on the amount of a color toner in the lower layer side.

According to the embodiment, the recess with the size largely affecting the image clarity can be controlled, and thus the image clarity can be efficiently and gradually controlled. According to the embodiment, the image clarity can be controlled only by increasing and decreasing the recesses, and thus the image clarity can be easily controlled without requiring any complicated calculation process.

According to the embodiment, it is possible to provide the image forming apparatus capable of performing glossiness control and image clarity control with higher accuracy than the conventional technology.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that includes an image forming unit which forms a chromatic toner image and a clear toner image on a recording material, and a fixing unit which fixes these toner images on the recording material, the image forming apparatus comprising:

a specifying unit into which a level of image clarity and a level of gloss including a glossiness of an image are input for image formation; and a control unit that controls an adhesion amount of clear toner per unit area on the recording material based on input information on the image specified by the specifying unit, wherein, the control unit controls a height of the clear toner with respect to the recording material to provide a recess on a surface of the toner image, and controls a number of recesses per unit area.

2. The image forming apparatus according to claim 1, wherein the specifying unit further comprises:

an area specifying unit into which an image area is specified; and an input unit into which a level of the image clarity and a level of the gloss including a glossiness in the specified image area are input.

3. The image forming apparatus according to claim 1, wherein, both a vertical width and a horizontal width of the recess on the surface of the toner image are 0.1 to 0.3 mm.

4. The image forming apparatus according to claim 1, wherein, the control unit decreases the number of recesses per unit area on the surface of the toner image to increase the image clarity, and increases the number of recesses per unit area on the surface of the toner image to reduce the image clarity.

5. The image forming apparatus according to claim 1, wherein the image forming apparatus controls fixing conditions of the fixing unit according to a type of the recording material.

* * * * *